US008403630B2

(12) United States Patent
Guemmer

(10) Patent No.: US 8,403,630 B2
(45) Date of Patent: Mar. 26, 2013

(54) BLADE SHROUD WITH FLUID BARRIER JET GENERATION

(75) Inventor: Volker Guemmer, Mahlow (DE)

(73) Assignee: Rolls-Royce Deutschland Ltd & Co KG (DE)

( * ) Notice: Subject to any disclaimer, the term of this patent is extended or adjusted under 35 U.S.C. 154(b) by 1153 days.

(21) Appl. No.: 12/222,529

(22) Filed: Aug. 11, 2008

(65) Prior Publication Data

US 2009/0047120 A1 Feb. 19, 2009

(30) Foreign Application Priority Data

Aug. 10, 2007 (DE) ..... 10 2007 037 855

(51) Int. Cl.
*F01D 9/06* (2006.01)

(52) U.S. Cl. ..... 415/115; 415/110; 415/116

(58) Field of Classification Search ..... 415/110–116
See application file for complete search history.

(56) References Cited

U.S. PATENT DOCUMENTS 4,534,701 A * 8/1985 Wisser ..... 415/168.4
6,109,867 A * 8/2000 Jacques Portefaix ..... 415/115
6,508,624 B2 1/2003 Nadeau et al.
7,287,957 B2 10/2007 Jahns et al.
2003/0131980 A1* 7/2003 DeMarche et al. ..... 165/169
2004/0018082 A1* 1/2004 Soechting et al. ..... 415/115

FOREIGN PATENT DOCUMENTS

EP 0943849 9/1999
EP 1531234 5/2005
WO 01/83950 11/2001

OTHER PUBLICATIONS

German Search Report dated Feb. 28, 2012 from counterpart foreign application.

* cited by examiner

*Primary Examiner* — H. Jey Tsai
(74) *Attorney, Agent, or Firm* — Timothy J. Klima; Shuttleworth & Ingersoll, PLC

(57) ABSTRACT

A fluid flow machine has a main flow path, in which at least one row of blades (1) is arranged, and a shroud (2), which is embedded in a recess (3) of a component, with the component and the blades (1) being in relative rotational movement to each other. The assembly forming the shroud includes at least one internal chamber (7) which is suppliable with fluid from a source. The at least one internal chamber (7) is connected to the main flow path surrounding the blades (1) or to a cavity (9) surrounding the shroud (2) via at least one outlet (8) which is arranged on one side of the shroud (2). The shape of the outlet (8) and the shape of the outlet opening are such that a fluid barrier jet is generated at the outlet (8), which stops recirculation of fluid through the shroud cavity (9).

17 Claims, 17 Drawing Sheets

Figure 2:
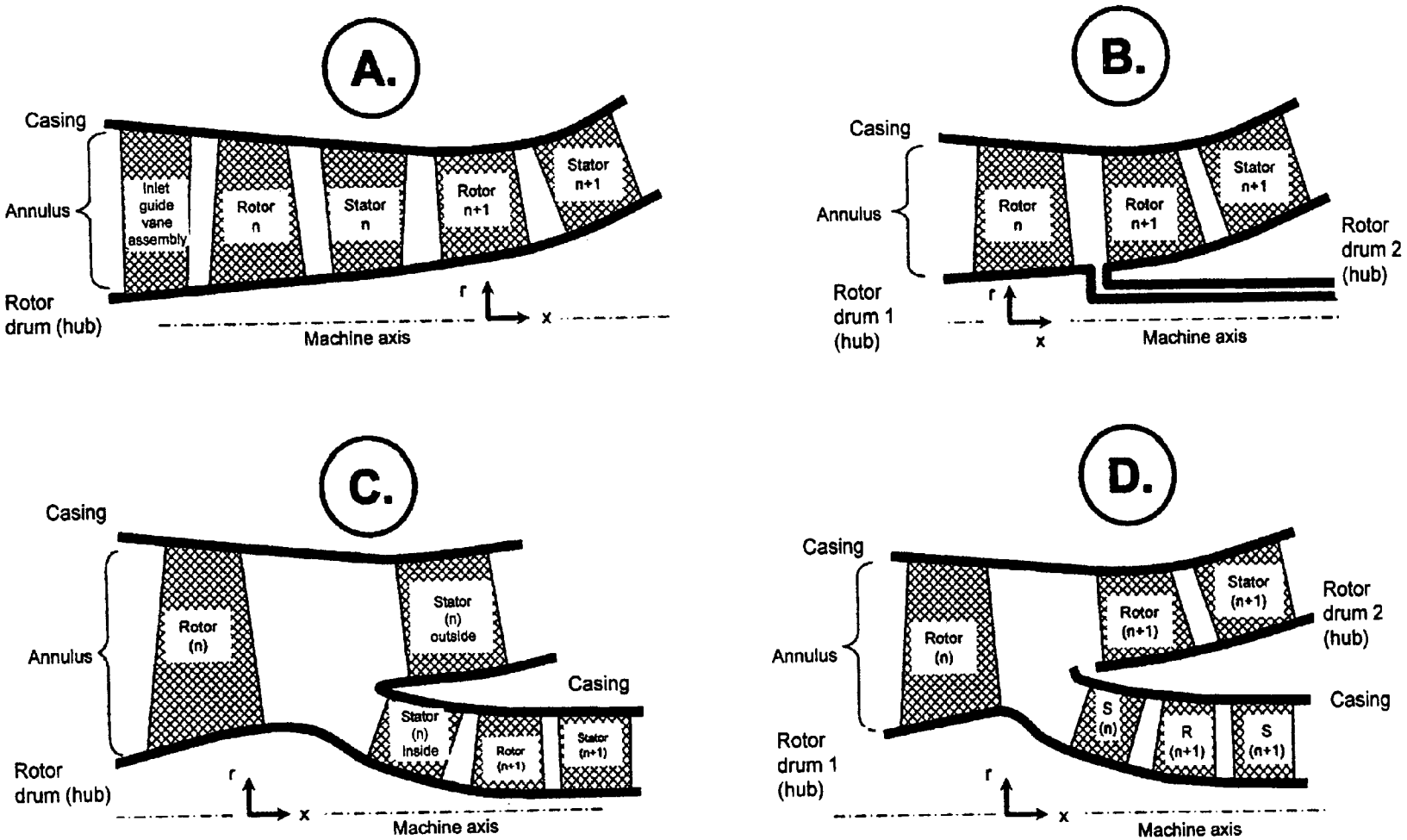

Fig.1a: State of the art
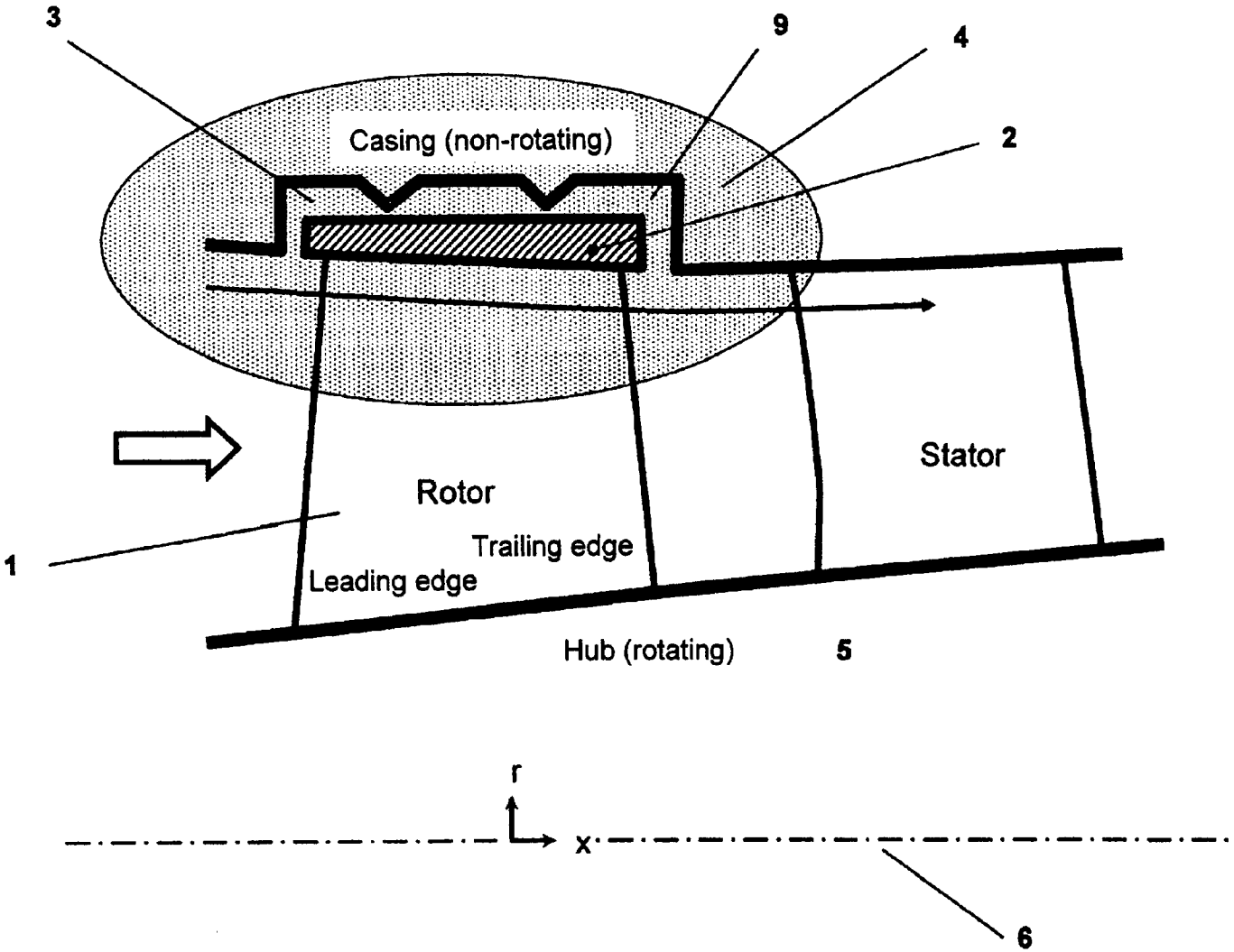

Fig.1b: State of the art
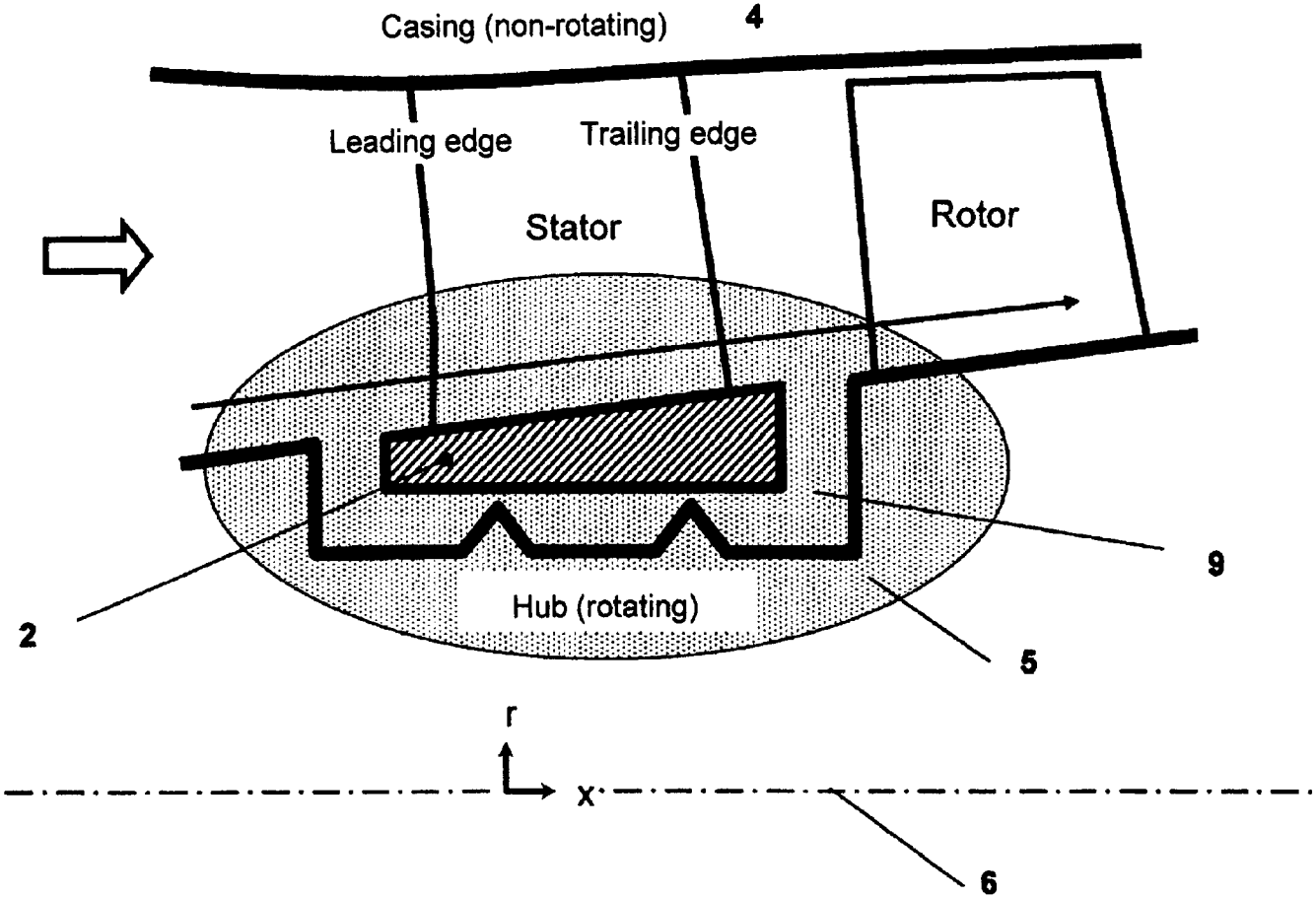

Fig.1c: State of the art
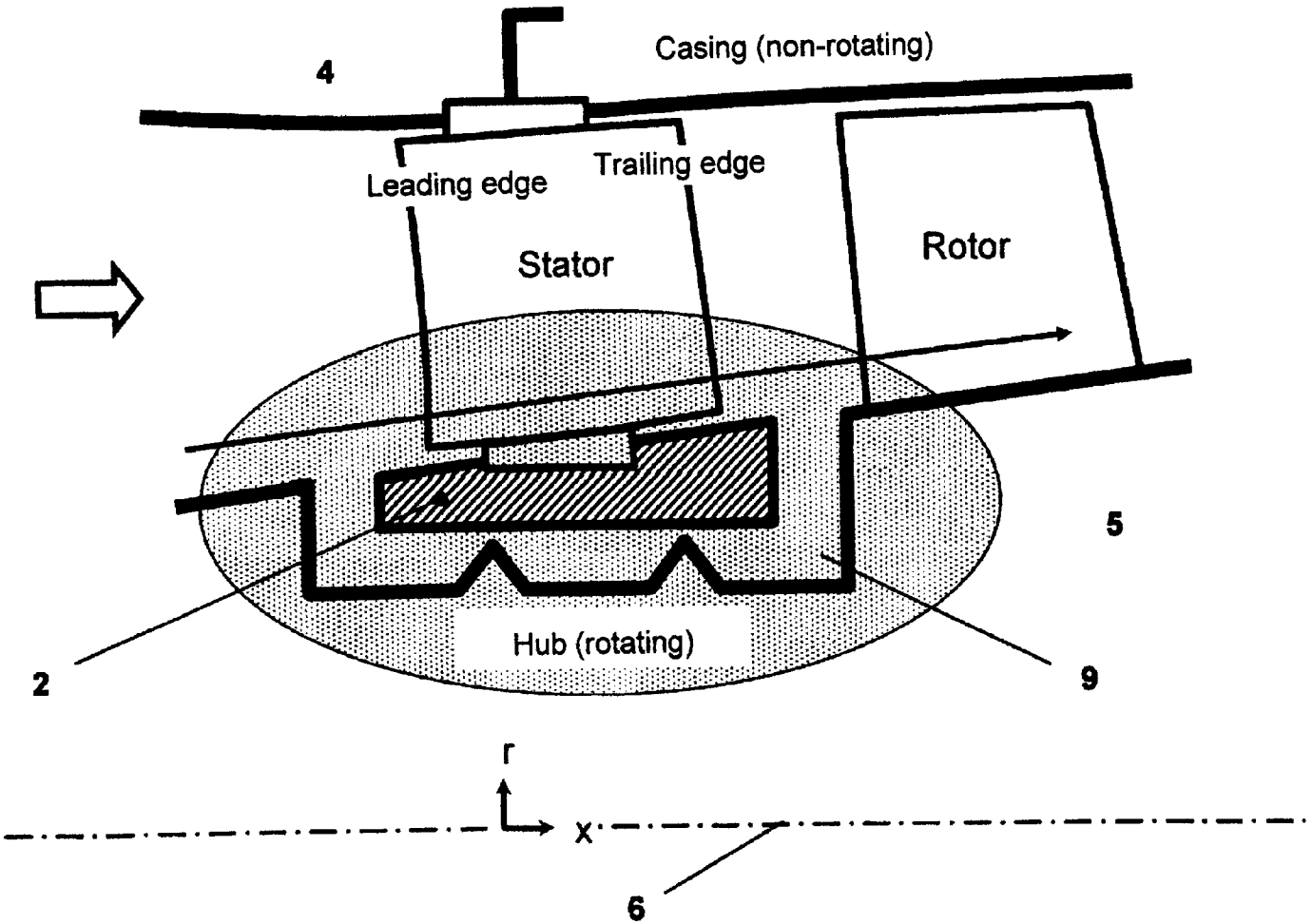

Fig.1d: State of the art
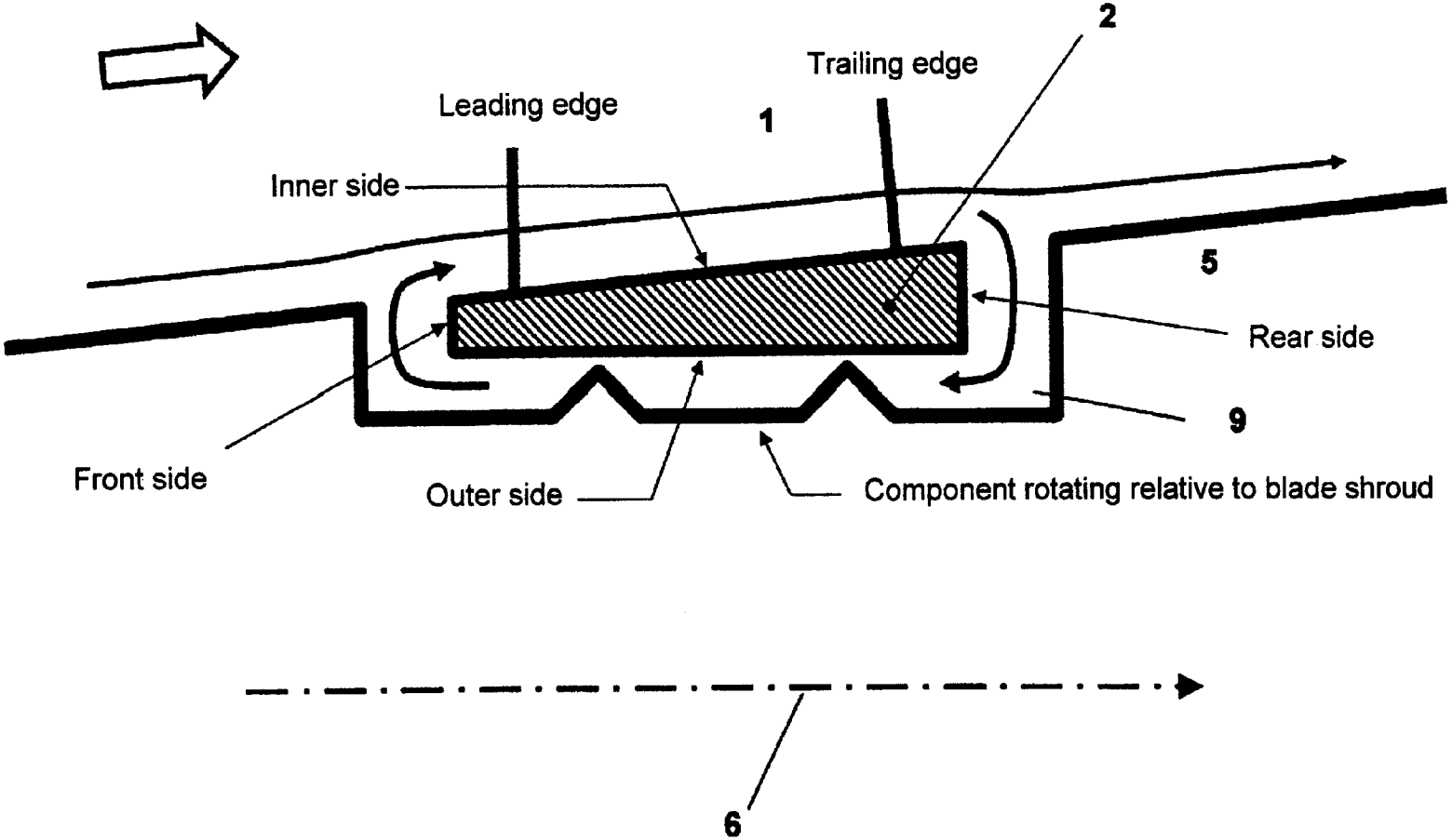

BLADE SHROUD WITH FLUID BARRIER JET GENERATION

This application claims priority to German Patent Application DE102007037855.8 filed Aug. 10, 2007, the entirety of which is incorporated by reference herein.

The aerodynamic loadability and the efficiency of fluid flow machines, for example blowers, compressors, pumps and fans, is limited by the growth and the separation of boundary layers on the blades as well as on the hub and casing walls. To remedy this fundamental problem, the state of the art provides solutions only to a limited extent. One source of the losses occurring in fluid flow machines is the leakage flow around the blade shrouds, as they are frequently provided on the inner blade end of stators or also on the outer blade end of rotors. The leakage flow is usually minimized by sealing fins which are arranged within the cavity, in which the shroud is embedded. Nevertheless, the leakage flow may severely affect the performance of fluid flow machines, in particular in aerodynamically very highly loaded blade rows which are characterized by a high static pressure increase and, thus, a strong propulsion for the leakage flow.

Specifications EP 1 531 234 B1, U.S. Pat. No. 6,508,624 B2 and/or WO 01/83950 A1 show a general state of the art.

FIG. 1*a* schematically shows a section of a fluid flow machine having a rotor blade row and a stator blade row. Particular prominence is given to the shroud arrangement on the outer blade end of the rotor. In accordance with the state of the art, the shroud arrangement has a large cavity 9 which is provided in the casing 4 and completely houses the shroud 2 to make the outer confinement of the main flow path as smooth as possible.

FIG. 1*b* schematically shows a section of a fluid flow machine having a fixed stator blade row and a rotor blade row. Particular prominence is given to the shroud arrangement on the inner blade end of the fixed stator. In accordance with the state of the art, the shroud arrangement has a large cavity 9 which is provided in the hub 5 and completely houses the shroud 2 to make the inner confinement of the main flow path as smooth as possible.

FIG. 1*c* schematically shows a section of a fluid flow machine having a row of adjustable (variable) stators and a rotor blade row. Particular prominence is given to the shroud arrangement on the inner blade end of the variable stator. In accordance with the state of the art, the shroud arrangement, also in this case, has a large cavity 9 which is provided in the hub 5 and completely houses the shroud 2 to make the inner confinement of the main flow path as smooth as possible.

FIG. 1*d* shows, typical of the shrouds of variable or fixed rotors and stators, an arrangement of three blade rows at the periphery of the main flow path of a fluid flow machine having an upstream blade row, a blade row with shroud 2 and a downstream blade row. This representation is applicable to both a region at the casing and a region at the hub of the fluid flow machine.

The shroud 2 is embedded in a surrounding component or a surrounding assembly (rotor hub 5 or casing 4) and, according to the state of the art, is arranged in smooth alignment, without protrusion, in the contour of the main flow path. The shroud 2 can be of the solid or hollow type (as not shown here) and includes one or more components. The leakage flow (small arrows) occurring between the shroud 2 and the surrounding component, which is opposite to the main flow direction (bold arrow), is reduced by a number of sealing fins. The sealing fins may be arranged on the surrounding component or also on the shroud itself (as not shown here). The surrounding component and the shroud are usually in relative movement to each other. In the area of the shroud, the leading edge (VK) and the trailing edge (HK) of the blade row considered are indicated. A thin, long arrow characterizes the rim-near flow along the essentially smooth border of the main flow path. The annular duct sections before and behind the shrouded blade row shown can either be unbladed or provided with at least one further blade row.

On shroud arrangements according to the state of the art, the leakage flow is essentially due to the gap formed between the sealing fins and the mating contour. The leakage flow here severely increases with the aerodynamic load selected for the shrouded blade row. This results in bad operating characteristics as regards efficiency, stability and width of the operating range of the fluid flow machine.

The present invention relates to blade rows of fluid flow machines, such as blowers, compressors, pumps and fans of the axial or semi-axial type using gaseous or liquid working media. The fluid flow machine may include one or several stages, each generally having a rotor and a stator, although in individual cases, the stage only has a rotor. The rotor includes a number of blades, which are connected to the rotating shaft of the machine and transfer energy to the working medium. The rotor may be designed with or without a shroud at the outer blade ends. The stator includes a number of stationary blades, which may either feature a fixed or a free blade end on the hub and on the casing side. A rotor drum and blading are usually enclosed by a casing. The machine may also include a stator, a so-called inlet guide vane assembly, upstream of the first rotor. Departing from the stationary fixation, at least one stator or inlet guide vane assembly may be rotatably borne, to change the angle of attack. Variation is accomplished for example via a spindle accessible from the outside of the annulus. In an alternative configuration, multi-stage types of said fluid flow machines may have two counter-rotating shafts, with the direction of rotation of the rotor blade rows alternating between stages. Here, no stators exist between subsequent rotors. Finally, the fluid flow machine may—alternatively—feature a bypass configuration such that the single-flow annulus divides into two concentric annuli behind a certain blade row, with each of these annuli housing at least one further blade row. FIG. 2 shows examples of four possible configurations of fluid flow machines.

In a broad aspect, the present invention provides a fluid flow machine and an appertaining shroud characterized by improved efficiency and optimized flow conditions.

In accordance with the present invention, a blade shroud arrangement is provided for application in a fluid flow machine which stops leakage through the cavity around the shroud by generating a fluid barrier jet.

More particularly, the present invention covers the design of the shroud of the blade row (rotor or stator) of a fluid flow machine such that a) the assembly forming the shroud is provided with an internal chamber in at least one circumferential location,
b) the internal chamber is supplied with fluid through at least one blade or at least one additional line,
c) the internal chamber of the shroud is connected to the main flow path or the cavity surrounding the shroud via at least one outlet duct, thereby generating a fluid barrier jet by means of which a leakage flow through the cavity surrounding the shroud is stopped.

Figure 3A:
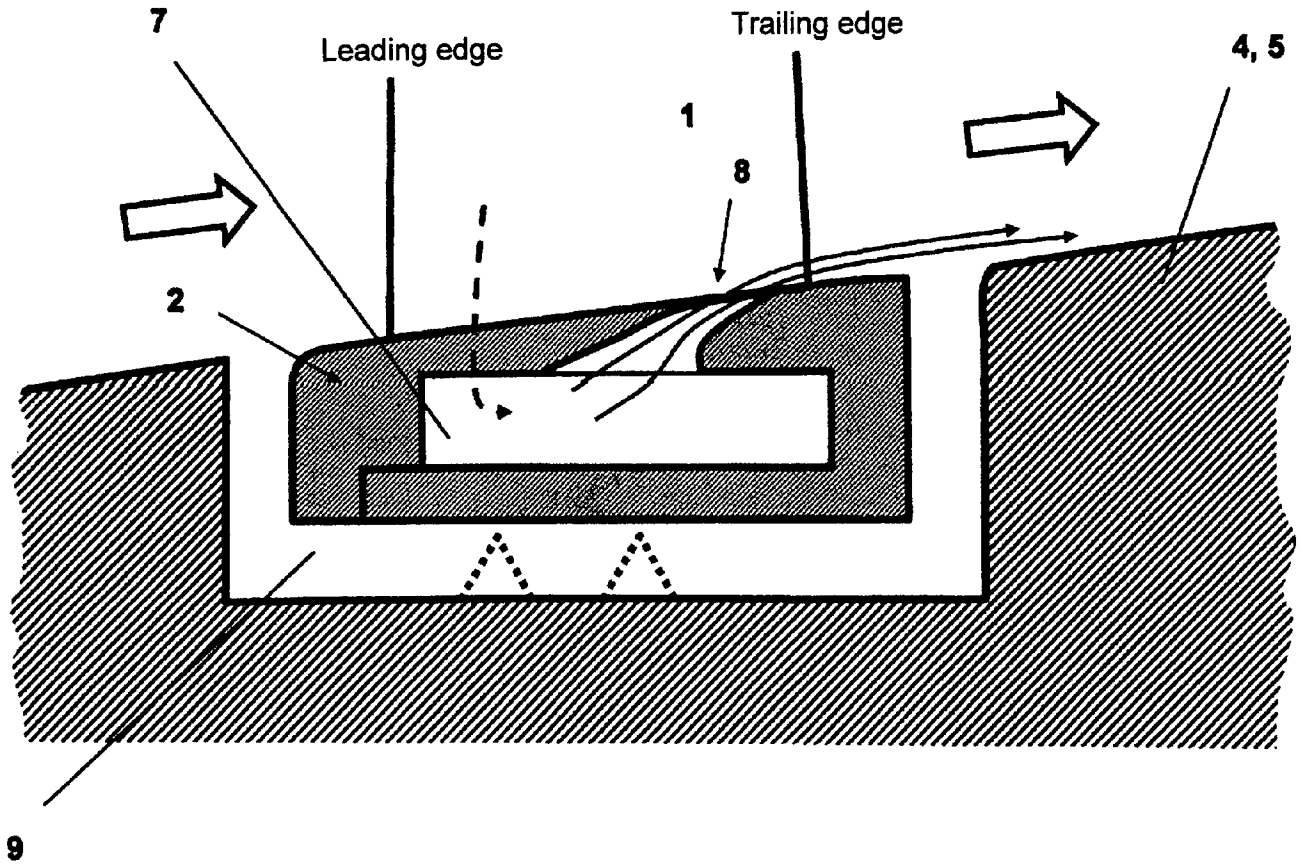
Figure 3B:
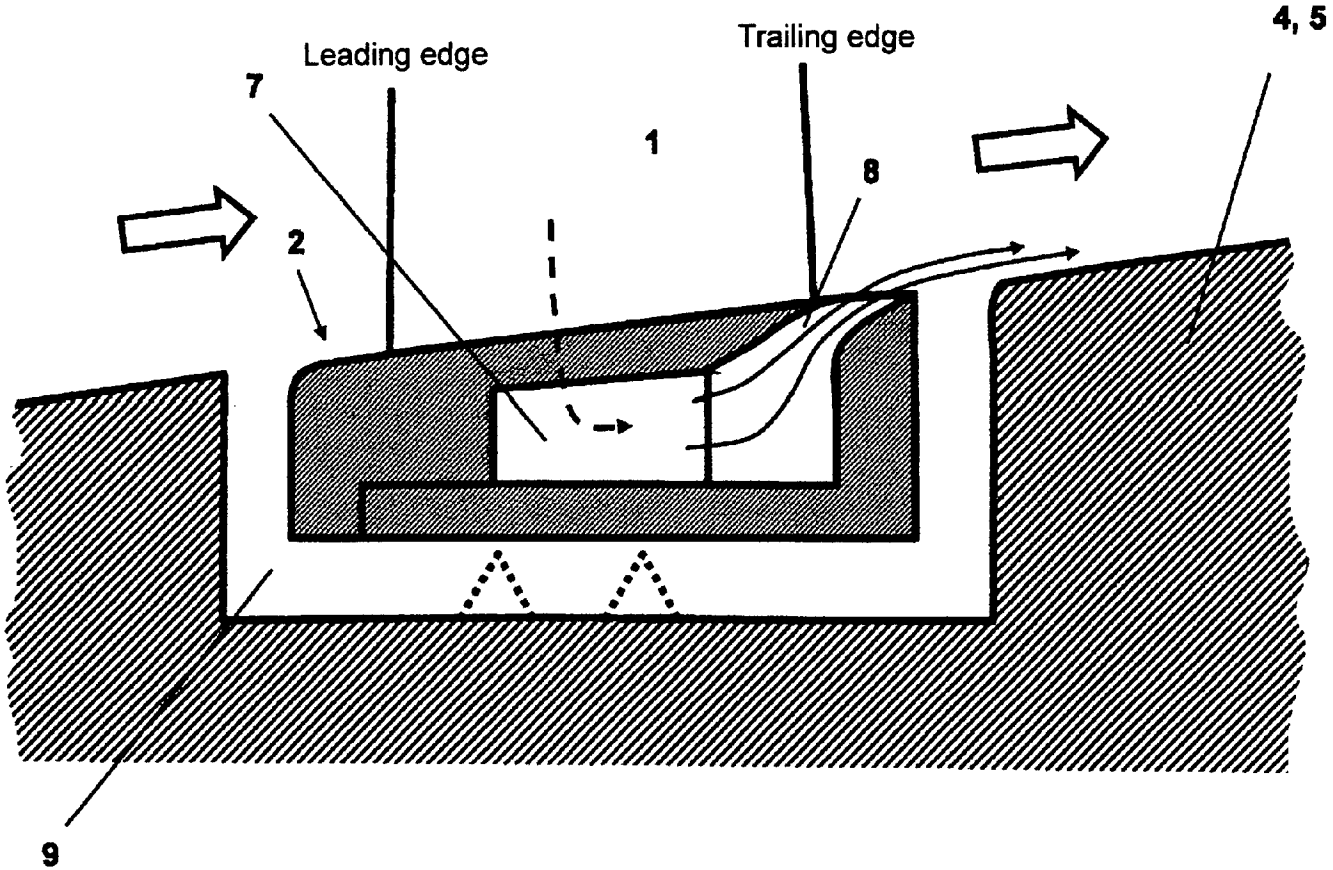
Figure 3C:
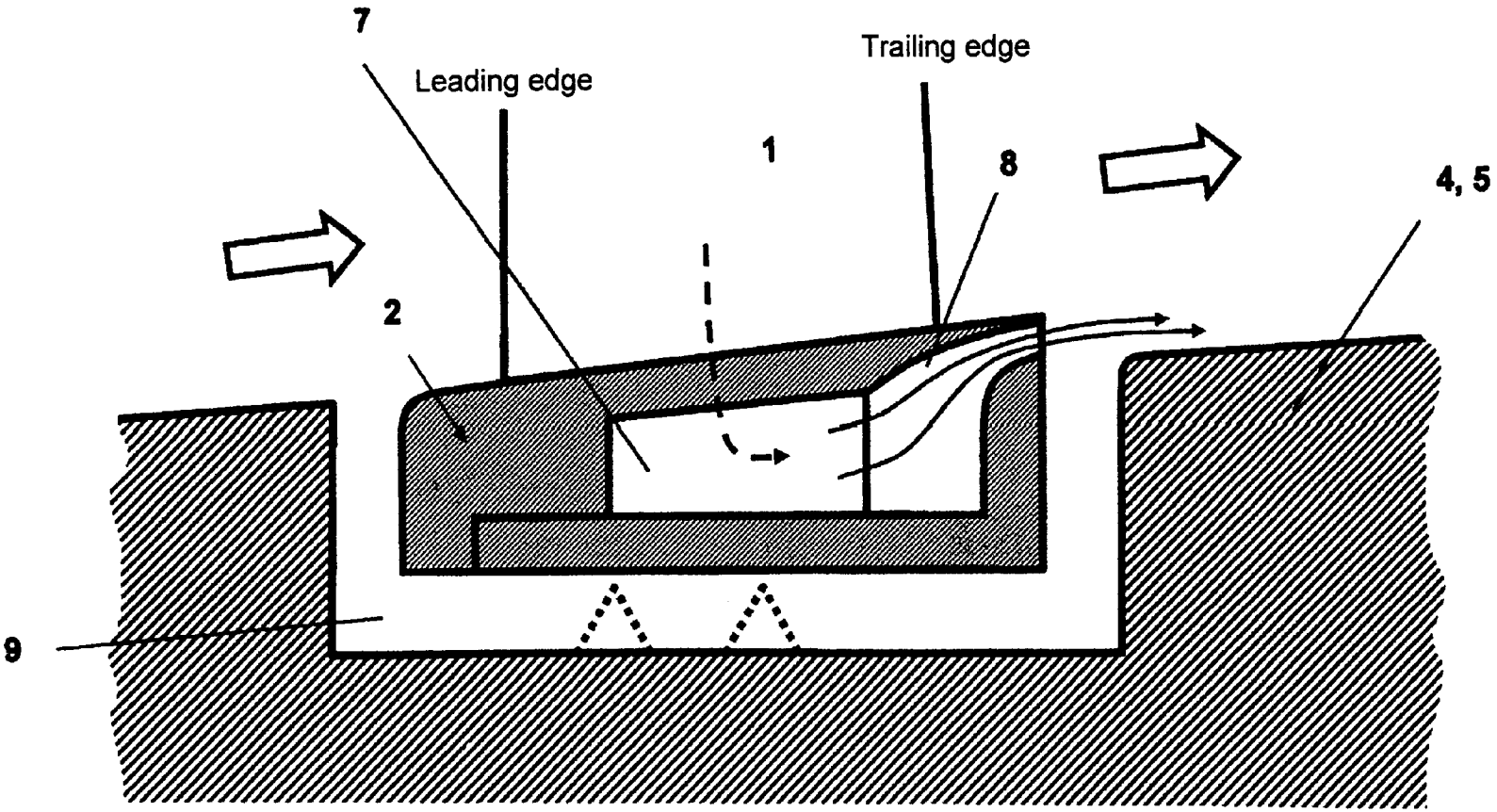
Figure 4A:
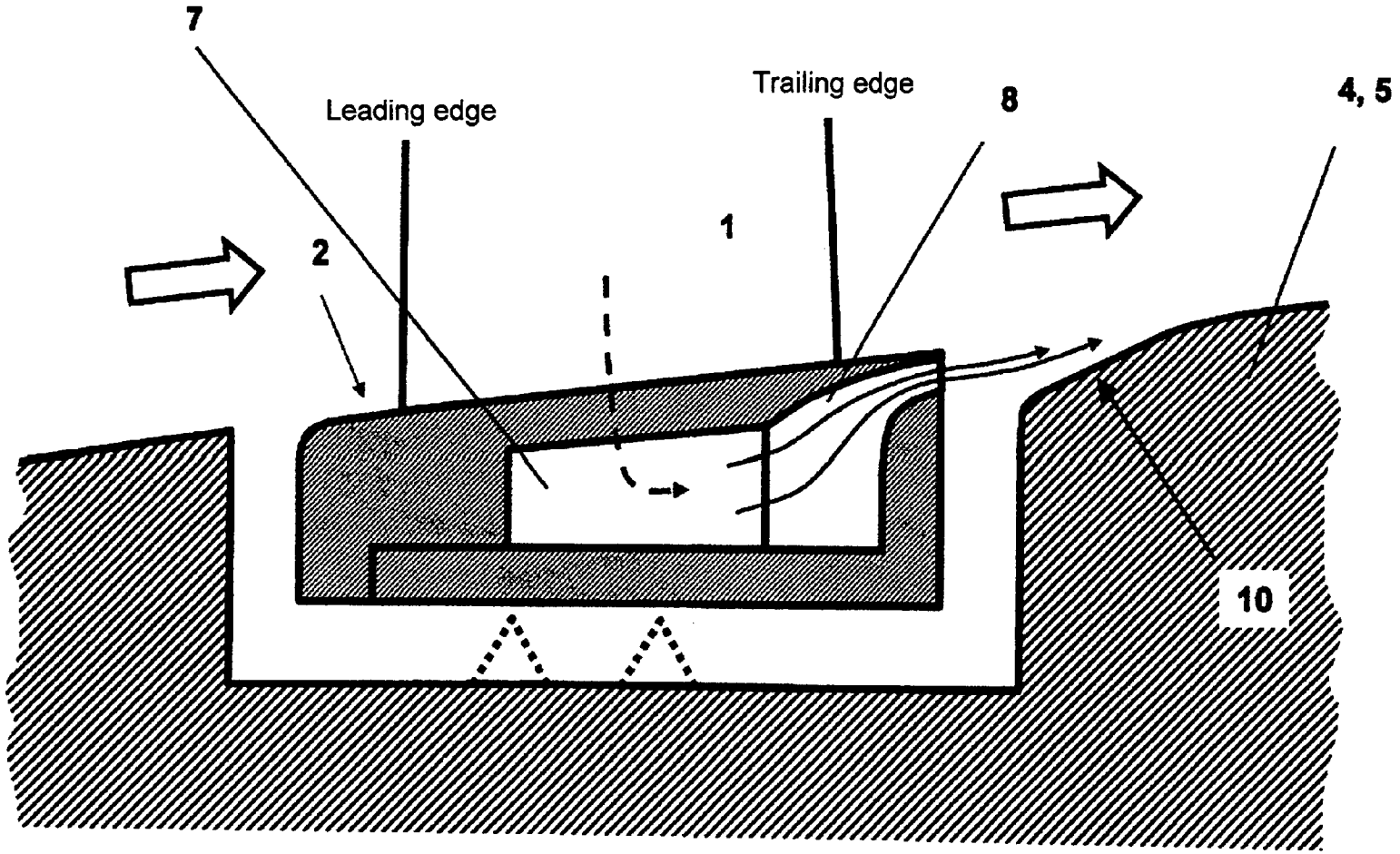
Figure 4B:
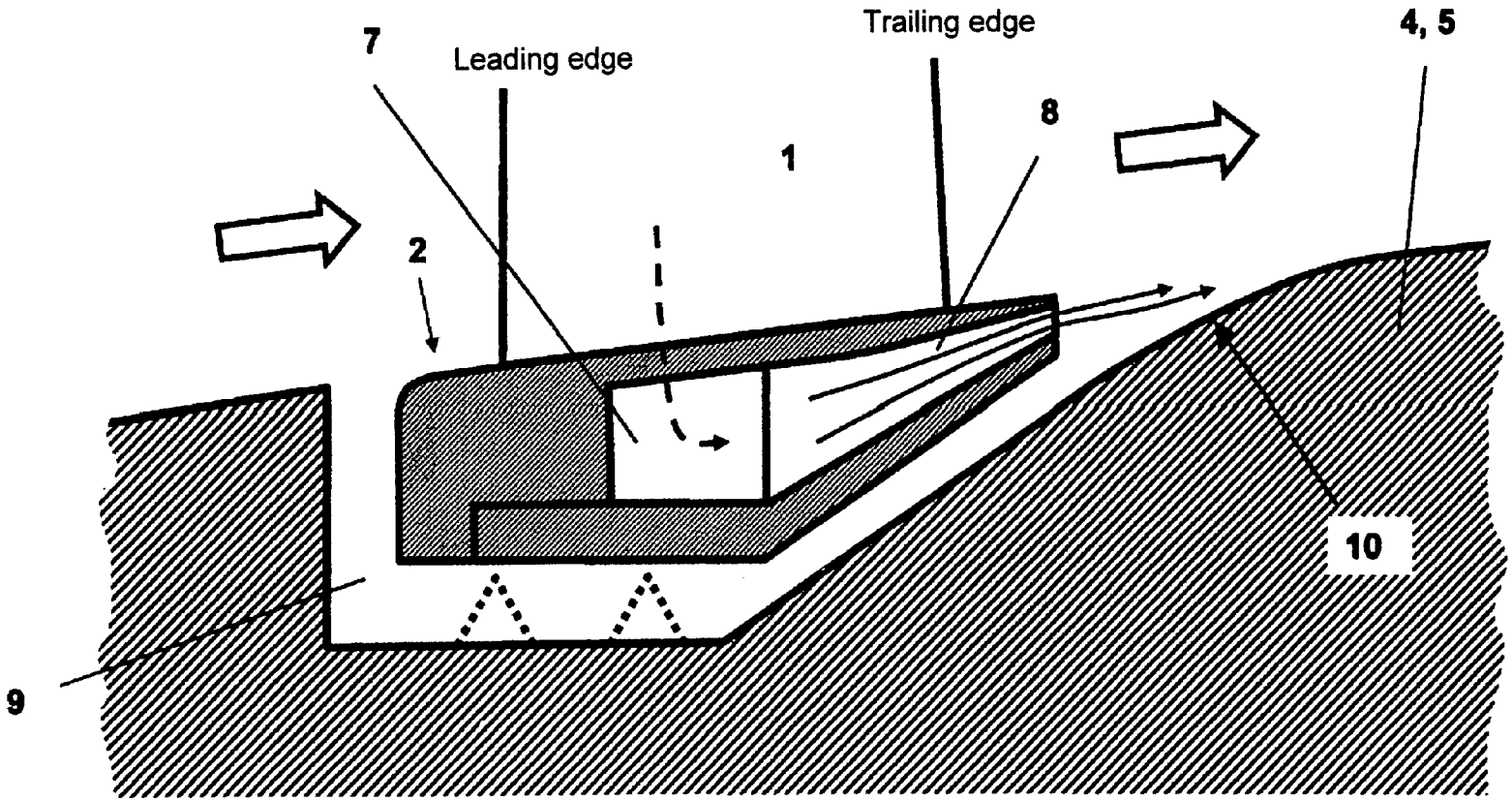
Figure 4C:
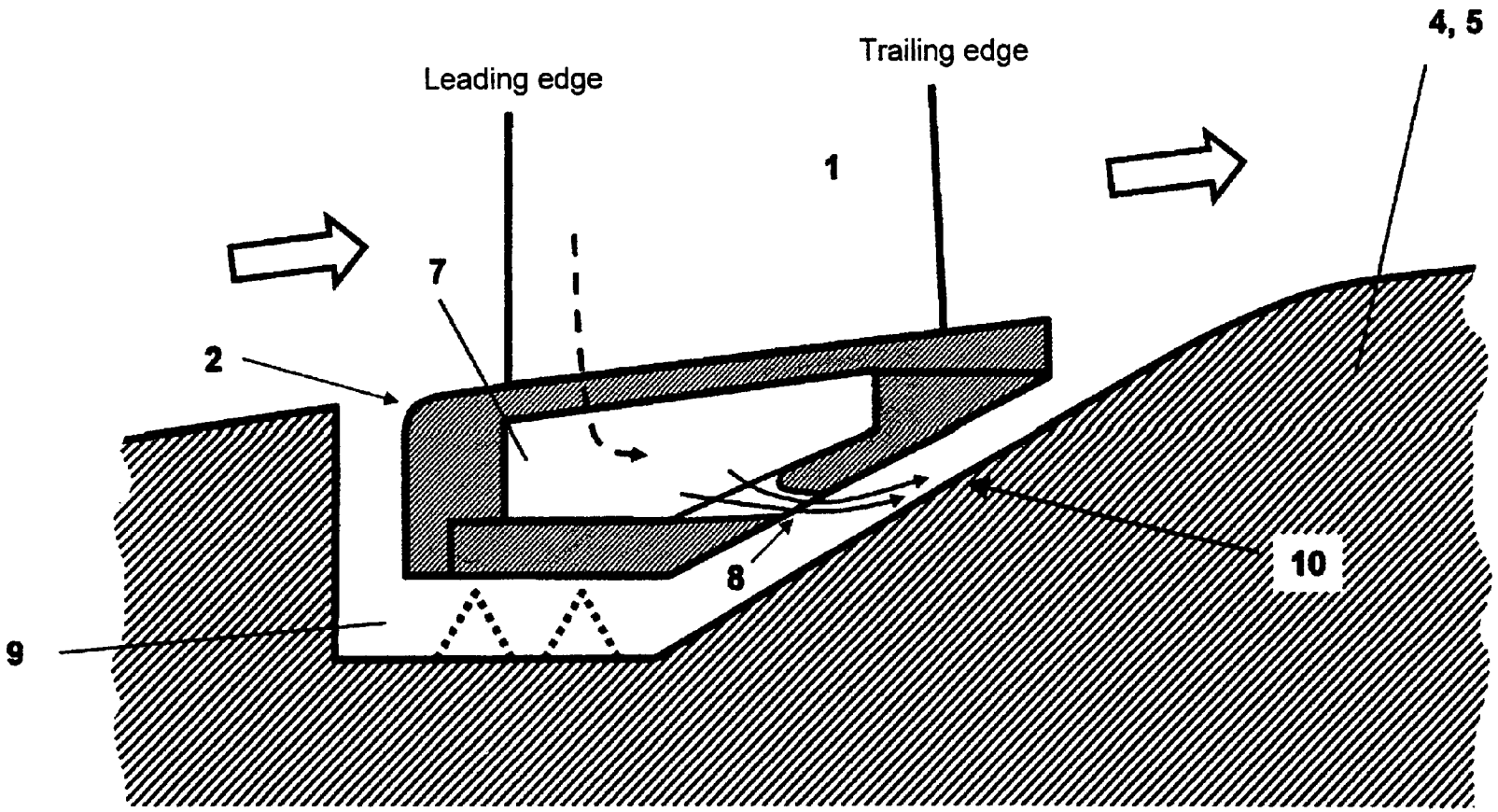
Figure 4D:
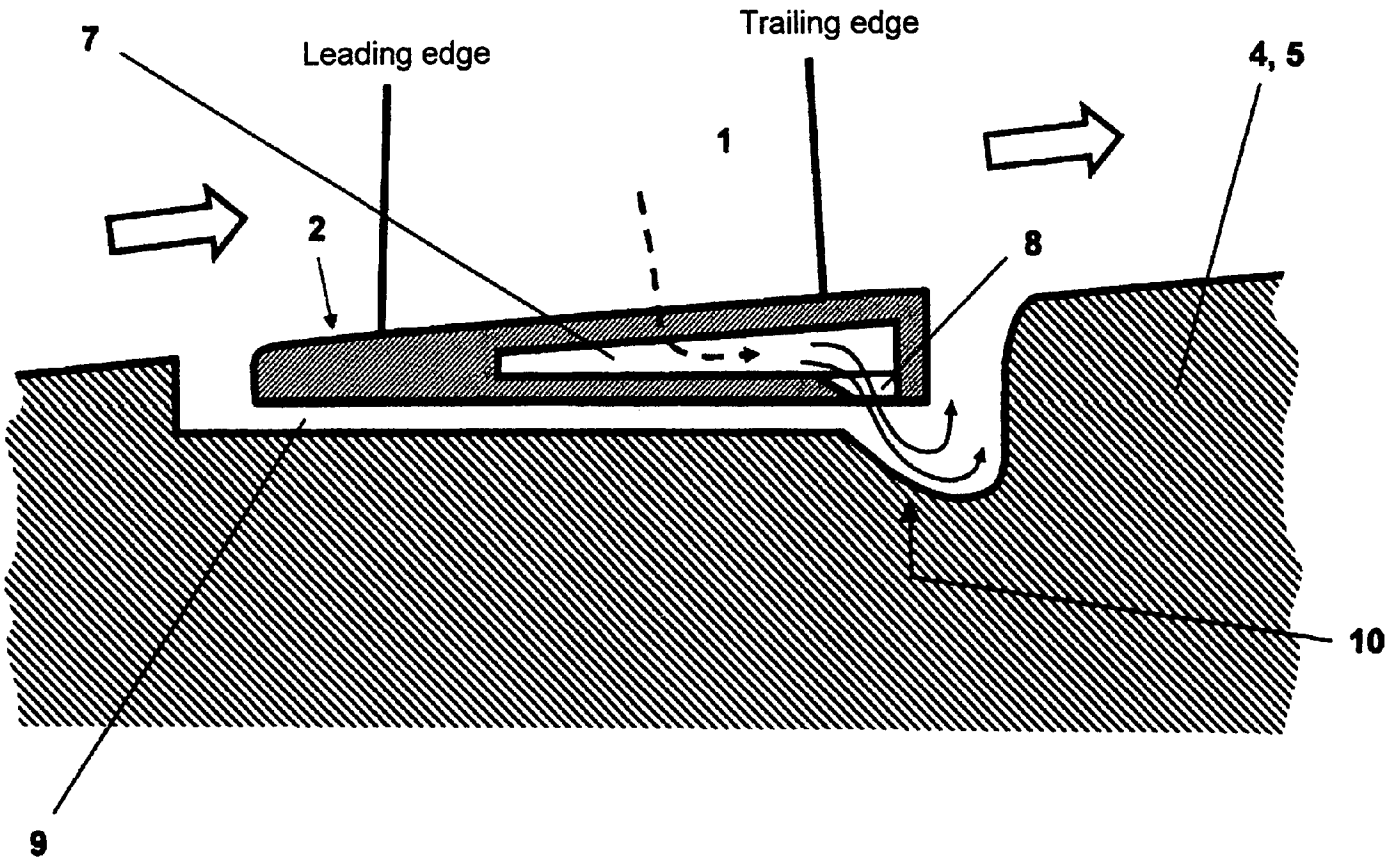
Figure 5A:
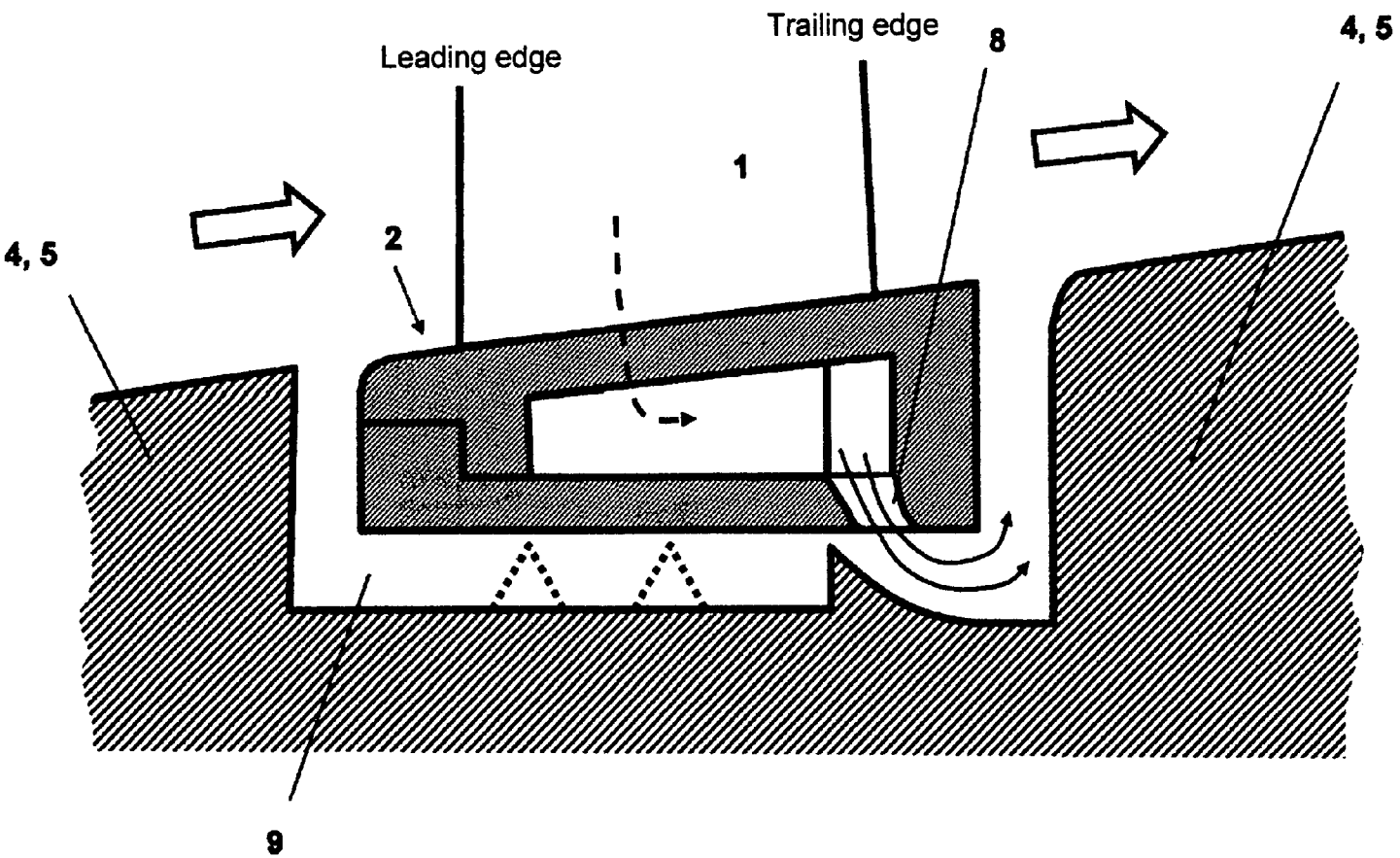
Figure 5B:
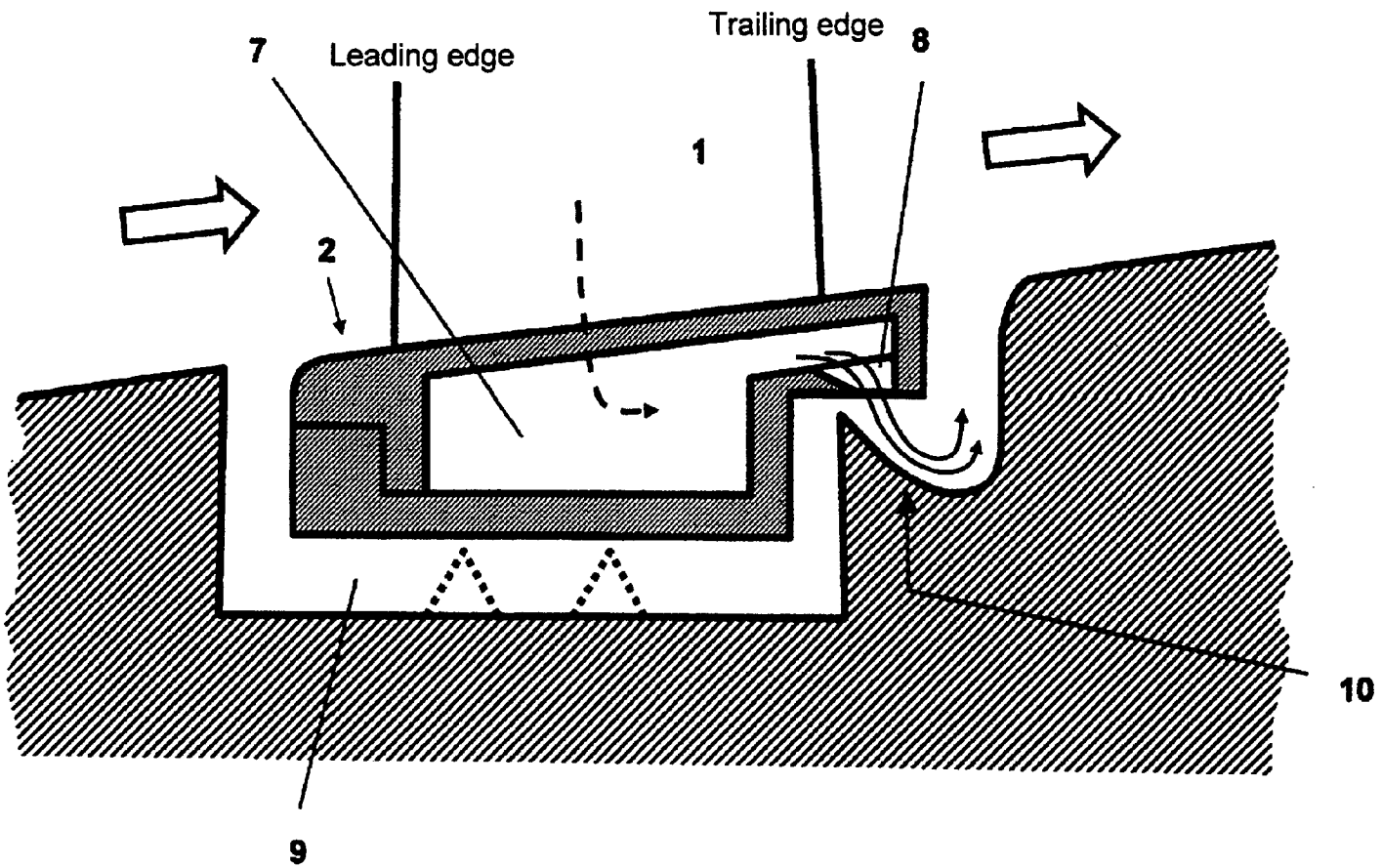
Figure 5C:
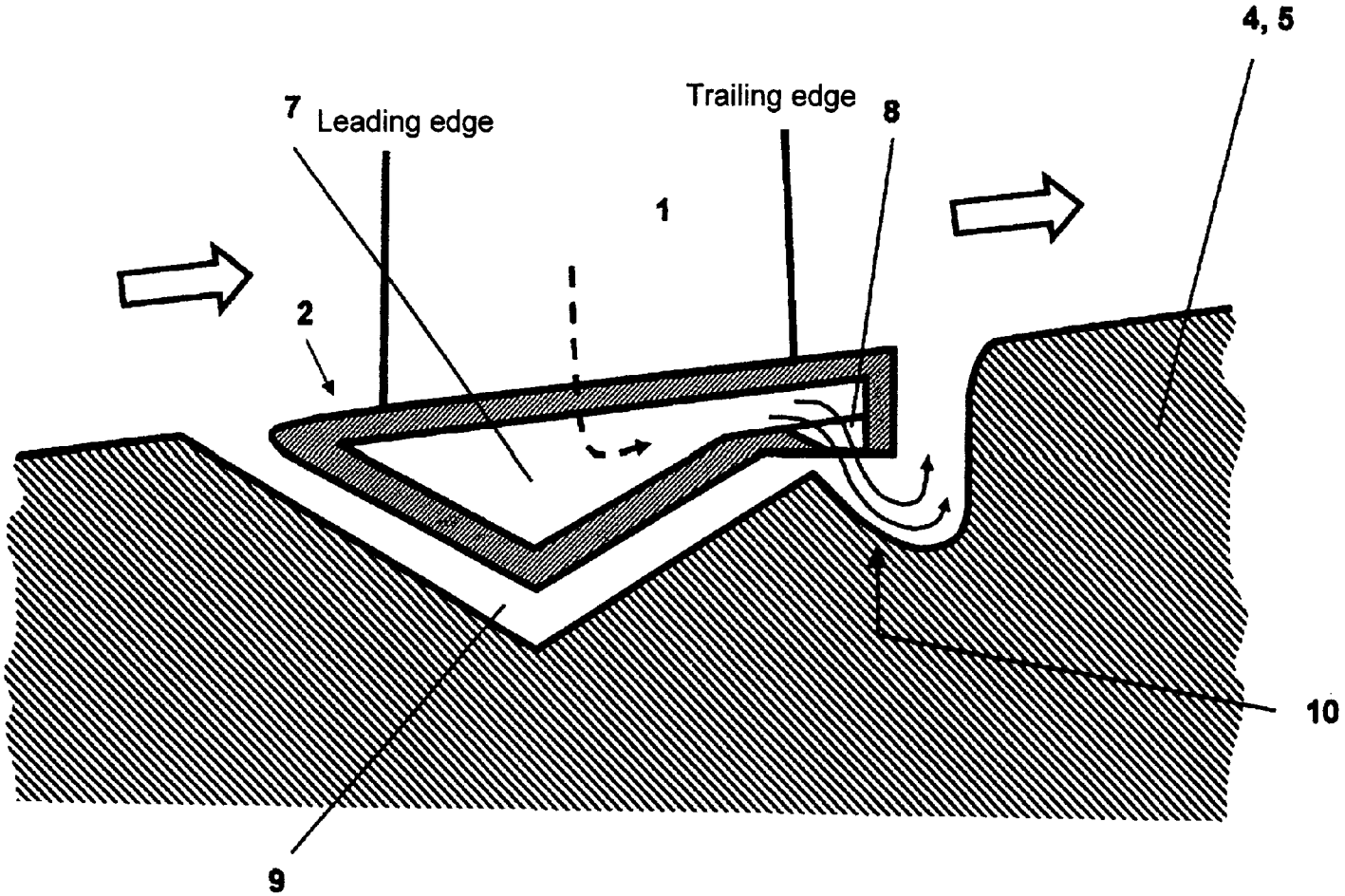
Figure 6A:
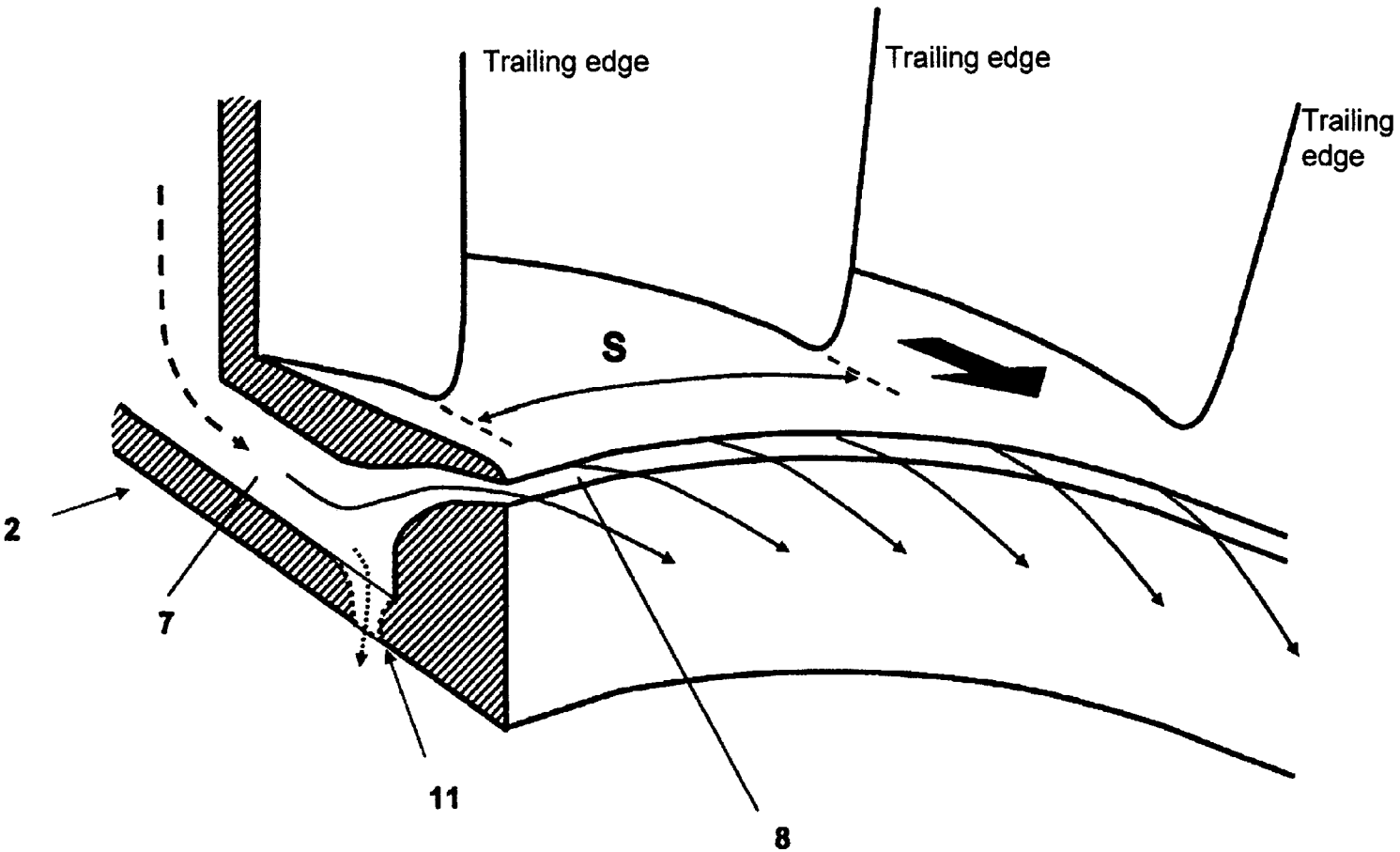
Figure 6B:
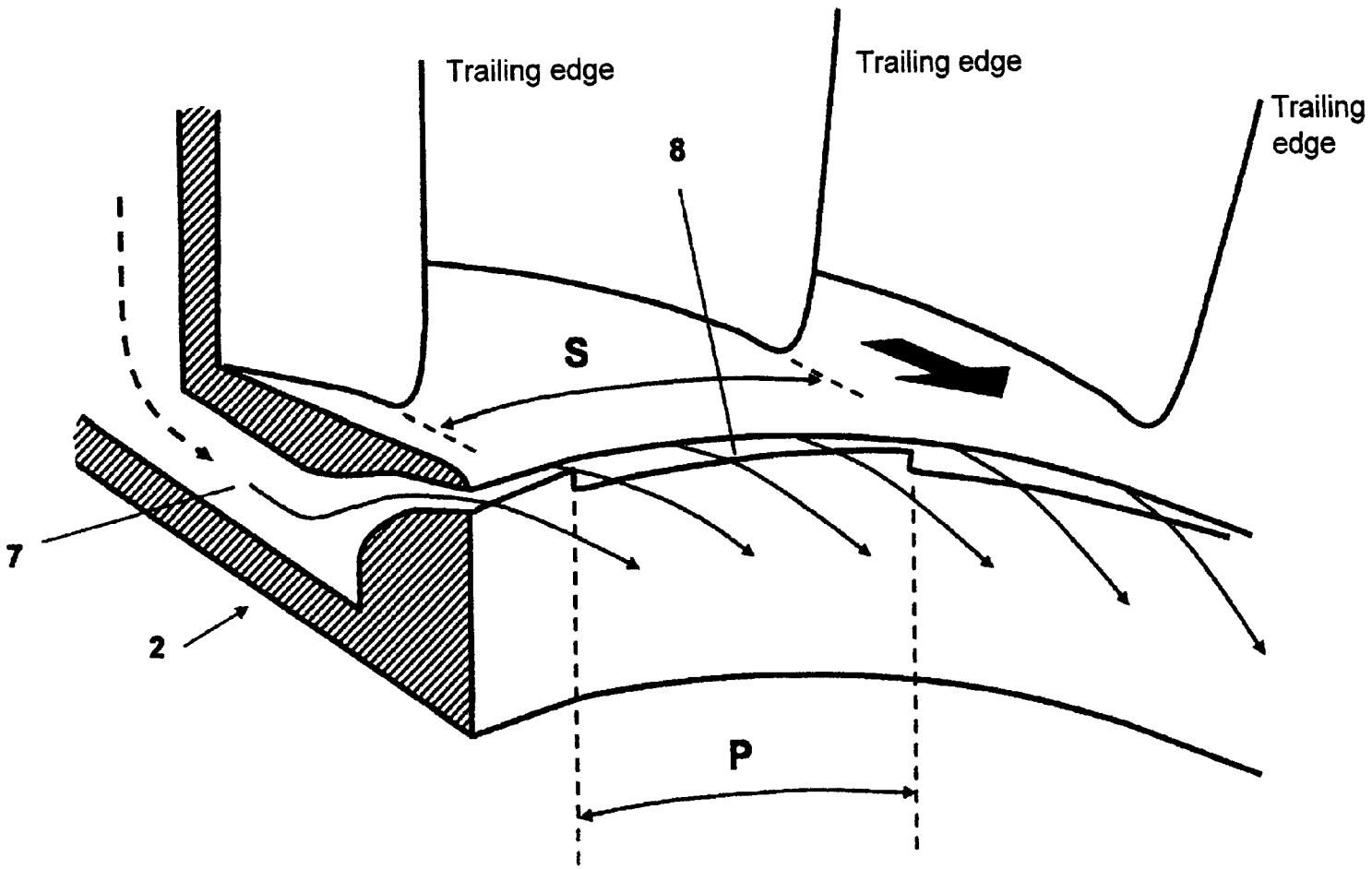

The present invention is more fully described in light of the accompanying drawings showing preferred embodiments. In the drawings, FIG. 1*a* shows a blade according to the state of the art, rotor, FIG. 1*b* shows a blade according to the state of the art, fixed stator, FIG. 1*c* shows a blade according to the state of the art, variable stator, FIG. 1*d* shows a blade-shroud configuration, state of the art, FIG. 2 shows possible configurations of fluid flow machines relevant to the present invention, FIG. 3*a* shows a shroud configuration in accordance with the present invention, without a flow ramp, variant 1, FIG. 3*b* shows a shroud configuration in accordance with the present invention, without a flow ramp, variant 2, FIG. 3*c* shows a shroud configuration in accordance with the present invention, without a flow ramp, variant 3, FIG. 4*a* shows a shroud configuration in accordance with the present invention, with a flow ramp in the main flow path, variant 1, FIG. 4*b* shows a shroud configuration in accordance with the present invention, with a flow ramp in the main flow path, variant 2, FIG. 4*c* shows a shroud configuration in accordance with the present invention, with a flow ramp in the cavity, FIG. 4*d* shows a shroud configuration in accordance with the present invention, with a flow ramp at the bottom of the cavity, FIG. 5*a* shows a shroud configuration in accordance with the present invention, with a combined sealing fin and flow ramp at the bottom of the cavity, FIG. 5*b* shows a shroud configuration in accordance with the present invention, with a combined sealing fin and flow ramp in the vicinity of the main flow path, variant 1, FIG. 5*c* shows a shroud configuration in accordance with the present invention, with a combined sealing fin and flow ramp in the vicinity of the main flow path, variant 2, FIG. 6*a* is a three-dimensional representation of a shroud in accordance with the present invention, exemplary for arrangements as per FIGS. 3*c* and 4*a*, FIG. 6*b* is a three-dimensional representation of a shroud in accordance with the present invention, with periodically varying width of the outlet.

In a conventional state-of-the-art shroud configuration, as shown in FIG. 1*d*, the peripheral flow enters the shroud cavity in the area of the trailing edge of the respective blade row without being hindered, and without actively influencing the recirculating leakage flow.

According to the present invention, a fluid barrier jet issuing from the shroud is generated by which the leakage flow is reduced or ideally stopped. This is implementable on each of the four sides of the shroud identified in FIG. 1*d:*

1) on the inner side (adjacent to the main flow path),
2) on the rear side (downstream),
3) on the outer side (facing the cavity bottom),
4) on the front side (upstream).

It is particularly favorable to arrange the barrier jet on the inner side, the rear side or the outer side.

Shroud configurations according to the present invention are shown in FIGS. 3*a* to 6. Though not shown here, the areas of the main flow path upstream and downstream of the blade row considered can, of course, accommodate further blade rows. Relevant for the present invention is the design of the shroud of the blade row under consideration.

FIGS. 3*a* to 3*c* show examples of shroud configurations according to the present invention which, compared to the conventional design of the fluid flow machine, do not require extensive changes to be made to the components in the environment of the shroud.

FIG. 3*a* shows an arrangement from a part of the main flow path and the shrouded end of a blade row with leading edge (VK) and trailing edge (HK). Two big arrows indicate the main flow in the fluid flow machine. According to the solution of the present invention here shown, the shroud 2 is provided with at least one internal chamber 7 extending over the entirety or only part of the circumference. The internal chamber 7 is supplied with fluid through at least one blade of the blade row pertaining to the shroud 2 or at least one additional line (see broken arrow). The internal chamber 7 connects to the main flow path via at least one outlet duct 8 and has an opening on the inner side of the shroud 2.

In accordance with the present invention, it is particularly advantageous if the opening of such an outlet 8 is disposed in the area of the trailing edge and features a nozzle-type shape. Since the fluid jet issuing from the opening flows in a straight line along the annular duct, it bars the access to the shroud cavity 9, thereby stopping a leakage flow through the cavity 9 against the main flow direction. In a particular form of the present invention, it can be advantageous, in particular for wear reduction, to dispense with the sealing fins routinely provided in the state of the art and indicated here by broken lines at the bottom of the cavity 9.

FIG. 3*b* shows a shroud configuration according to the present invention in which the opening of the outlet duct 8 is disposed downstream of the trailing edge on the inner side of the shroud 2, thereby generating the fluid barrier jet very closely to the access to the cavity 9.

FIG. 3*c* shows a shroud configuration according to the present invention in which the opening of the outlet duct 8 is disposed downstream of the trailing edge on the rear side of the shroud 2, thereby generating the fluid barrier jet again very closely to the access to the cavity 9. This arrangement of the present invention requires that, in the area of the trailing edge of the shrouded blade row, the shroud 2 protrudes into the main flow path in order to produce a necessary step and ensure undisturbed inflow of the barrier jet into the further course of the main flow path.

FIG. 4*a* shows a shroud configuration according to the present invention in which the opening of the outlet duct 8 is disposed downstream of the trailing edge on the rear side of the shroud 2, thereby again generating the fluid barrier jet very closely to the access to the cavity 9. This arrangement of the present invention does not provide for a protrusion of the shroud 2 into the main flow path to form a necessary step, but employs a flow ramp 10 on the component surrounding the shroud to ensure undisturbed inflow of the barrier jet into the further course of the main flow path, with the flow ramp 10 being also extendable into the bladed area of a blade row optionally arranged downstream, if applicable. The flow ramp is arranged in direct extension and environment of the direction of outflow of the fluid jet from the outlet opening.

FIG. 4*b* shows a shroud configuration according to the present invention in which the opening of the outlet duct 8 is arranged downstream of the trailing edge on the rear side of the shroud 2. This arrangement of the present invention provides for a flow ramp 10 on the component surrounding the shroud to ensure undisturbed inflow of the barrier jet into the further course of the main flow path, with the flow ramp 10 extending far in the direction of the bottom of the cavity 9 and also being extendable into the bladed area of a blade row optionally arranged downstream, if applicable.

FIG. 4*c* shows a shroud configuration according to the present invention in which the opening of the outlet duct 8 is arranged in the vicinity of the obliquely oriented outer respectively rearward side of the shroud 2. This arrangement of the present invention provides for a contour of the cavity 9 opposite of the outlet opening which acts as a flow ramp 10, thereby ensuring that the barrier effect is obtained and the fluid of the barrier jet is issued to the main flow path.

FIG. 4*d* shows a shroud configuration according to the present invention in which the opening of the outlet duct 8 is disposed in the vicinity of the rear side of the shroud 8 on the outer side of the shroud 8. This arrangement of the present invention provides for a flow ramp 10 approximately opposite of the outlet opening, with the flow ramp 10 extending from the bottom of the cavity 9. This ensures that the barrier effect is obtained and the fluid of the barrier jet is issued to the main flow path.

FIG. 5*a* shows a shroud configuration according to the present invention in which the opening of the outlet duct 8 is disposed on the outer side of the shroud 2. This arrangement of the present invention provides for a flow ramp 10 approximately opposite of the outlet opening which is also part of a sealing fin at the bottom of the cavity 9. Where sealing fins are provided, this is a particularly favorable design provision to ensure that the barrier effect is obtained and the fluid of the barrier jet is issued to the main flow path.

FIG. 5*b* shows a shroud configuration according to the present invention in which the opening of the outlet duct 8 is disposed in the vicinity of the rear side of the shroud 2 on the outer side of the shroud 2. This arrangement of the present invention provides for a flow ramp 10 approximately opposite of the outlet opening, which is also part of a sealing fin arranged as closely as possible to the main flow path. At least one further step exists towards the bottom of the cavity 9.

FIG. 5*c* shows a shroud configuration according to the present invention in which the opening of the outlet duct 8 is disposed in the vicinity of the rear side of the shroud 2 on the outer side of the shroud 2. This arrangement of the present invention provides for a flow ramp 10 approximately opposite of the outlet opening, which is also part of a sealing fin arranged as closely as possible to the main flow path. The outer side of the shroud 2 and the cavity surface are here V-shaped.

FIG. 6*a* shows, in three-dimensional representation, a shroud according to the present invention by way of example of the arrangement as per FIG. 3*c* or FIG. 4*a*. Looking upstream on the trailing edges of the blades, the ends of three blades of a shrouded blade row can be seen. The section through the arrangement of blade and shroud at the left-hand side of the illustration schematically shows the passage of fluid through at least one of the blades to the internal chamber 7 of the shroud 2 and the discharge of the fluid barrier jet through the outlet opening 8 at the rear side of the shroud 2.

In accordance with the present invention, at least one further outlet originating at one of the internal chambers can favourably be provided which is disposed either on the same side or another side of the shroud, for example:

a) an outlet on the inner side in combination with an outlet on the rear side of the shroud,
b) an outlet on the rear side in combination with an outlet on the outer side of the shroud (as indicated by dotted lines in FIG. 6*a*),
c) two outlets on the inner side arranged one behind the other in machine axis direction,
d) two outlets on the rear side arranged one above the other in blade height direction, etc.

In the representation selected in FIG. 6*a*, the outlet opening has an axially symmetric, continuous slot of constant width. Falling within the scope of the present invention are however also those outlet openings which provide a similar functional effect, such as:

a) a circumferentially interrupted slot,
b) a circumferentially interrupted slot, with the number of interruptions being established as unity or multiple of the number of blades,
c) a circumferential hole row,
d) an arrangement of inclined or, if applicable, circumferentially overlapping slots, etc.

Of course, the features of multiple outlets and functionally similar outlet types described in connection with FIG. 6*a* are not only applicable to the formation shown with an outlet on the shroud rear side, but to all further outlet arrangements described as falling within the scope of the present invention.

Finally, FIG. 6*b* shows an arrangement similar to FIG. 6*a*, but with a periodically varying width of the outlet 8 in the circumferential direction. In accordance with the present invention, it is particularly favorable if the period of variation of the outlet width essentially corresponds to the pitch of the pertinent blades of the blade row, i.e. S equal or approximately equal to P.

Further description of the present invention:

Item 1:

Shroud of a blade row of rotatable or non-rotatably fixed stator or rotor blades for use in a fluid flow machine, in particular in an aircraft engine compressor, with special shape to reduce recirculating leakage flows through the shroud cavity, characterized in that a.) the assembly forming the shroud is provided with at least one internal chamber over the entirety or a part of the circumference,
b.) the at least one internal chamber is supplied with fluid from an available source either through at least one blade or through at least one additional line,
c.) the at least one internal chamber is connected to the main flow path surrounding the blades or to the cavity surrounding the shroud via at least one outlet,
d.) the at least one outlet extends over the entirety or a part of the circumference and is arranged on one of the four sides of the shroud (inner, rear, outer, front side),
e) the shape of the outlet and the shape of the outlet opening are designed such that a fluid barrier jet is generated at the outlet, which stops the recirculation of fluid through the shroud cavity.

Item 2:

Shroud in accordance with item 1, characterized in that at least one outlet for fluid barrier jet generation is arranged on the main flow path on the shroud inner side in the vicinity of the blade trailing edge.

Item 3:

Shroud in accordance with items 1 or 2, characterized in that at least one outlet for fluid barrier jet generation is disposed in immediate vicinity of the main flow path on the shroud rear side and the shroud features a step (protrusion) in this area to provide for undisturbed distribution of the fluid barrier jet along the confinement of the main flow path.

Item 4:

Shroud in accordance with one of the items 1 to 3, characterized in that at least one outlet for fluid barrier jet generation is disposed in immediate vicinity of the main flow path on the shroud rear side and a flow ramp in direct extension of the outlet duct is provided on the component surrounding the shroud towards which the fluid barrier jet is directed and which, in the further course, ensures that the fluid barrier jet attaches to the confinement of the main flow path.

Item 5:

Shroud in accordance with one of the items 1 to 4, characterized in that at least one outlet for fluid barrier jet generation is disposed on the shroud outer side and a flow ramp in direct extension of the outlet duct is provided on the component surrounding the shroud, towards which the fluid barrier jet is directed and which, in the further course, ensures that the fluid barrier jet attaches to the confinement of the shroud cavity and that the fluid barrier jet is fed to the main flow path.

Item 6:

Shroud in accordance with one of the items 1 to 5, characterized in that the flow ramp adjoins a protrusion of the cavity contour surrounding the shroud in the form of a sealing fin, thereby obtaining a locally and functionally combined effect of sealing fin and barrier jet.

Item 7:

Shroud in accordance with one of the items 1 to 6, characterized in that, as viewed in the meridional section of the fluid flow machine, at least one further outlet originating at one of the internal chambers is provided at another location on one of the shroud sides.

Item 8:

Shroud in accordance with one of the items 1 to 7, characterized in that at least one outlet opening is formed by an axially symmetric, circumferentially continuous slot of constant width.

Item 9:

Shroud in accordance with one of the items 1 to 7, characterized in that at least one outlet opening is formed by an axially symmetric, circumferentially interrupted slot of constant width.

Item 10:

Shroud in accordance with one of the items 1 to 9, characterized in that the number of interruptions is established as unity or multiple of the number of blades of the respective blade row with shroud.

Item 11:

Shroud in accordance with one of the items 1 to 10, characterized in that at least one outlet opening is established by a circumferentially extending row of holes.

Item 12:

Shroud in accordance with one of the items 1 to 11, characterized in that at least one outlet opening is established by a circumferentially oriented grouping of slots inclined against the circumferential direction and, if applicable, overlapping in circumferential direction.

Item 13:

Shroud in accordance with one of the items 1 to 12, characterized in that the width of the outlet opening varies periodically in circumferential direction and the circumferential angular amount or the circumferential length, respectively, of the variation period P essentially corresponds to, or is a multiple of, the circumferential angular amount or the circumferential length of a blade pitch S.

Item 14:

Shroud in accordance with one of the items 1 to 13, characterized in that the outlet duct features a contracting, i.e. nozzle-type, cross-section towards the outlet opening.

Item 15:

Shroud in accordance with one of the items 1 to 14, characterized in that no further sealing fins are provided on the shroud or the cavity contour, except in combination with a flow ramp ensuring the efficiency of the fluid barrier jet.

The present invention provides for a significantly higher aerodynamic loadability of rotors and stators in fluid flow machines, with efficiency being maintained or even improved. It is expected that the application of the concept to the high-pressure compressor of an aircraft engine with approx. 25,000 lbs thrust leads to a reduction of the specific fuel consumption of up to 0.5 percent.

List Of Reference Numerals

1 Blade
2 Shroud
3 Recess
4 Casing
5 Hub
6 Machine axis
7 Internal chamber
8 Outlet
9 Cavity
10 Flow ramp
11 Outlet

What is claimed is:

1. A fluid flow machine comprising:

a main flow path, including a portion in which energy is transferred to the fluid and in which at least one row of blades having a shroud is arranged, with the shroud positioned in a cavity of a component, with the component and the blades being in relative rotational movement to each other, wherein, the shroud includes at least one internal chamber, the at least one internal chamber is supplied with fluid from a source, the at least one internal chamber is connected to at least one chosen from the main flow path surrounding the blades and the cavity surrounding the shroud via at least one outlet, the at least one outlet is positioned on one side of the shroud, and a shape of the outlet and a shape of the outlet opening are configured such that a fluid barrier jet is generated at the outlet, which stops recirculation of fluid through the shroud cavity, the outlet positioned such that the fluid barrier jet is released downstream of any seal between the shroud and the cavity;

the component including a flow ramp positioned in an area of the outlet opening for guiding the fluid barrier jet into the main flow path, with a trajectory of at least one chosen from the outlet and the fluid barrier jet impinging on the flow ramp;

wherein the at least one internal chamber is supplied with fluid via at least one chosen from at least one blade and at least one additional line, from a source having a pressure higher than a static pressure at a side of the shroud facing the main flow path.

2. The fluid flow machine of claim 1, wherein the shroud includes the at least one internal chamber over an entirety of its circumference.

3. The fluid flow machine of claim 1, wherein the shroud includes the at least one internal chamber over part of its circumference.

4. The fluid flow machine of claim 1, wherein the at least one outlet is disposed on the shroud inner side in the vicinity of a blade trailing edge.

5. The fluid flow machine of claim 1, wherein the at least one outlet is disposed in an immediate vicinity of the main flow path on the shroud rear side and the shroud includes a protrusion in this area to provide for undisturbed distribution of the fluid barrier jet along the confinement of the main flow path.

6. The fluid flow machine of claim 1, wherein the at least one outlet is disposed in an immediate vicinity of the main flow path on the shroud rear side and the flow ramp is in direct extension of the outlet towards which the fluid barrier jet is directed and which, in the further course, ensures that the fluid barrier jet attaches to the confinement of the main flow path.

7. The fluid flow machine of claim 1, wherein the at least one outlet is disposed on the shroud outer side and the flow ramp is in direct extension of the outlet towards which the fluid barrier jet is directed and which, in the further course, ensures that the fluid barrier jet attaches to the confinement of the shroud cavity and that the fluid barrier jet is fed to the main flow path.

8. The fluid flow machine of claim 6, wherein the flow ramp adjoins a protrusion of the cavity contour surrounding the shroud in the form of a sealing fin, thereby obtaining a locally and functionally combined effect of sealing fin and barrier jet.

9. The fluid flow machine of claim 1, and comprising, at least one further outlet originating at an internal chamber is positioned on one of the shroud sides, as viewed in a meridional section of the fluid flow machine.

10. The fluid flow machine of claim 1, wherein the at least one outlet is formed by an axially symmetric, circumferentially continuous slot of constant width.

11. The fluid flow machine of claim 1, wherein the at least one outlet is formed by an axially symmetric, circumferentially interrupted slot of constant width.

12. The fluid flow machine of claim 11, wherein a number of the interruptions is established as an integral multiple of a number of blades of the respective blade row with the shroud.

13. The fluid flow machine of claim 1, wherein the at least one outlet includes a circumferentially extending row of holes.

14. The fluid flow machine of claim 1, wherein the at least one outlet includes a circumferentially oriented grouping of slots inclined against a circumferential direction and/or overlapping in the circumferential direction.

15. The fluid flow machine of claim 1, wherein a width of the outlet varies periodically in a circumferential direction and a circumferential angular amount or the circumferential length, respectively, of a variation period (P) essentially corresponds to, or is a multiple of, a circumferential angular amount or a circumferential length of a blade pitch (S).

16. The fluid flow machine of claim 6, wherein the outlet duct includes at least one of a contracting and nozzle-type cross-section towards the outlet.

17. The fluid flow machine of claim 16, wherein the only sealing fin(s) included on at least one chosen from the shroud and the contour of the cavity are in combination with the flow ramp ensuring the efficiency of the fluid barrier jet.

* * * * *